US006300608B2

(12) United States Patent
Inoh et al.

(10) Patent No.: US 6,300,608 B2
(45) **Date of Patent: *Oct. 9, 2001**

(54) INDUCTION HEATING COIL AND INDUCTION HEATING DEVICE USING THE INDUCTION HEATING COIL

(75) Inventors: Hideo Inoh, Fuchu; Suetaka Omura, Osaka; Takashi Fujisawa, Saitama; Hiroyuki Fuchigami, Sagamihara, all of (JP)

(73) Assignees: Denki Kogyo Co., Ltd., Tokyo; Chugai Ro Co., Ltd., Osaka, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/402,964

(22) PCT Filed: Nov. 19, 1998

(86) PCT No.: PCT/JP98/05190

§ 371 Date: Oct. 12, 1999

§ 102(e) Date: Oct. 12, 1999

(87) PCT Pub. No.: WO99/41952

PCT Pub. Date: Aug. 19, 1999

(30) Foreign Application Priority Data

Feb. 13, 1998 (JP) ..... 10-30695

(51) Int. Cl.[7] ..... H05B 6/40; H05B 6/10

(52) U.S. Cl. ..... 219/646; 219/656; 219/672; 219/673; 266/129; 148/567

(58) Field of Search ..... 219/645, 646, 219/635, 653, 656, 672, 673, 676; 266/129; 148/567, 572

(56) References Cited

U.S. PATENT DOCUMENTS

| | | | | |
|---|---|---|---|---|
| 5,317,121 | * | 5/1994 | Katayama et al. | 219/672 |
| 5,495,094 | * | 2/1996 | Rowan et al. | 219/645 |
| 5,630,958 | * | 5/1997 | Stewart, Jr. et al. | 219/672 |
| 5,837,976 | * | 11/1998 | Loveless et al. | 219/645 |

FOREIGN PATENT DOCUMENTS

| | | |
|---|---|---|
| 58-15889 | 9/1983 | (JP) . |
| 3-91696 U | 9/1991 | (JP) . |
| 5-234669 | 9/1993 | (JP) . |

* cited by examiner

*Primary Examiner*—Philip H. Leung
(74) *Attorney, Agent, or Firm*—Alston & Bird LLP

(57) ABSTRACT

There are provided an induction heating coil for carrying out high frequency induction heating (heating during movement) of a hot rolled steel or the like by surrounding the hot rolled steel or the like which is placed on a plurality of conveying rollers and conveyed, and an induction heating apparatus using this induction heating coil. In an induction heating coil 2 for induction heating a heated body (a thin slab 8 or the like) by surrounding it, a first coil portion 13 wound in a spiral form while transferring in one direction (the direction of the arrow mark α) along a coil axis S and a second coil portion 14 which is connected to a terminal (turn point 18) of the first coil portion 13 and wound back while transferring in the other direction (the direction of the arrow mark β) along the coil axis S are combined so as to overlap in the non-contact state.

14 Claims, 8 Drawing Sheets

INDUCTION HEATING COIL AND INDUCTION HEATING DEVICE USING THE INDUCTION HEATING COIL

TECHNICAL FIELD

The present invention relates to an induction heating coil for carrying out high frequency induction heating (heating during movement) of a hot rolled steel or the like by surrounding the hot rolled steel or the like which is placed on a plurality of conveying rollers and conveyed, and an induction heating apparatus using this induction heating coil.

BACKGROUND ART

On a hot coil production line at an electric furnace minimill, for example, high frequency induction heating using high frequency electric power of high energy density has widely been used conventionally to heat a thin slab (a kind of hot rolled steels) produced by continuous casting. FIGS. 8 and 9 show an induction heating apparatus 20 that has been generally used to heat a thin slab on a continuous production line. This apparatus 20 has a construction such that a thin slab 21, which is continuously cast in a continuous casting section outside the figure and is supplied to a heating section, is subjected to induction heating (high frequency heating during movement) under a moving condition.

As shown in FIGS. 8 and 9, the induction heating apparatus 20 is made up of a plurality of steel-made conveying rollers 23 arranged at intervals along a predetermined conveyance path, a solenoid-type induction heating coil 22 fixedly arranged between the adjacent conveying rollers 23, and a high frequency power source 24 for supplying high frequency electric power to the induction heating coil 22. The aforementioned induction heating coil 22 used as heating means is a solenoid-type coil wound a plurality of turns in a spiral form. Specifically, as shown in FIGS. 8 to 10, the induction heating coil 22 is formed by the repetition of a configuration of one turn consisting of a lower winding portion 22*a,* a side winding portion 22*b* rising upward from one end of the lower winding portion 22*a,* an upper winding portion 22*c* connecting with the upper end of the side winding portion 22*b,* and a side winding portion 22*d* falling downward from one end of the upper winding portion 22*c*.

Thus, a thin slab 21 is placed on the plurality of conveying rollers 23 and conveyed so as to pass through a hollow portion (a portion surrounded by coil winding) of the solenoid-type induction heating coil 22. More specifically, the thin slab 21, which is supplied continuously from the continuous casting section outside the figure, is placed on the plurality of rollers 23, which are rotated at an equal speed in the same direction, and is conveyed in a predetermined direction (in the direction of the arrow mark X in FIGS. 8 and 9). At this time, high frequency electric power of the high frequency power source 24 is transmitted to the thin slab 21, which is a heated body, by means of the induction heating coil 22, whereby the thin slab 21 is heated to a predetermined temperature by high frequency induction heating during the movement. In this case, the conveying speed of the thin slab 21, the rotational speed of the conveying roller 23, and the high frequency electric power of the high frequency power source 24 are controlled in accordance with the type of the thin slab 21, by which the heating temperature of the thin slab 21 is controlled.

In order to efficiently heat both of the upper and lower surfaces of the thin slab (heated body) 21 with a thickness of about 20 to 30 mm and a width of about 1000 to 1400 mm, the shape of an opening portion 25 of the induction heating coil 22, that is, a coil shape viewed from a plane perpendicular to a coil axis $S_1$ is made rectangular, and the area of the opening portion 25 is determined so as to be at a necessary minimum. The axis $S_1$ of the induction heating coil 22 is arranged so as to be substantially in alignment with the axis $S_2$ of the thin slab 21 (see FIG. 9).

The induction heating coil 22 is excited by the high frequency power source 24, and the frequency of the high frequency power source 24 is set at about 5 to 6 KHz so that the penetration depth of induced current is not larger than a half of the thickness of the thin slab 21. An electromagnetic field (magnetic flux) generated by the induction heating coil 22 produces an eddy current in the thin slab 21. Taking the eddy current as I and the electric resistance of the thin slab 21 as R, Joule heat of $I^2R$ is produced, so that the temperature of the thin slab 21 increases. A higher heating electric power is more effective in increasing the productivity of minimill and in shortening the production line. Therefore, with the high-power high frequency power source 24 of 1000 to 2000 KW, which is the highest class that can be achieved by the present-day technology, and the induction heating coil 22 being one set, several sets to ten and over sets are arranged in series in the conveying direction of thin slab, thereby forming one heating line.

However, the induction heating coil 22 produces a slightly but non-negligible, harmful eccentric magnetic flux in addition to a magnetic flux parallel with the coil axis $S_1$, which is effective in heating the thin slab 21. This eccentric magnetic flux is generally caused by the coil winding that is wound in a spiral form while shifting in the direction along the coil axis $S_1$, that is, the coil winding that is wound at a predetermined lead angle θ (see FIG. 10) in the solenoid-type induction heating coil 22. In this case, the lead angle is an angle formed between a line $S_3$ in the direction perpendicular to the coil axis $S_1$ (a line in the direction agreeing with the coil width direction and the width direction of the thin slab 21) and the upper winding portion 22*c* of the induction heating coil 22 as shown in FIG. 10. Taking the lead angle as θ, cos θ is an effective component, and sin θ is a component that produces the eccentric magnetic flux. In an example in which the opening size of the opening portion 25 of the induction heating coil 22 is 1600 mm×110 mm, the depth size is 280 mm, and the winding material is a copper pipe of 50 mm×30 mm, the lead angle θ is about 1°.

FIG. 11 shows induced current components produced on the upper surface of the thin slab 21 by electromagnetic induction caused by the induction heating coil 22 wound so as to have the lead angle θ. As shown in FIG. 11, on the upper surface and in the vicinity thereof of the thin slab 21, an induced current $i_0$ flows in the direction along the upper winding portion 22*c*. In this case, an induced current component $i_1=i_0\cos\theta$ flowing in the width direction of the thin slab 21 is produced as a component effectively contributing to the induction heating of the thin slab 21, and on the other hand, an induced current component $i_2=i_0\sin\theta$ flowing in the direction of the axis $S_2$ of the thin slab 21 (or the direction of the axis $S_1$ of the induction heating coil 22) is produced as a component harmful to the induction heating of the thin slab 21. That is to say, if the eccentric magnetic flux is present, the induced current component $i_2$ flowing in the axial direction of the thin slab 21 is produced (see FIGS. 8 and 11).

If the induced current component $i_2$ flowing in the direction of the axis $S_2$ of the thin slab 21 is produced in this manner, an axial current $i_2$ indicated by the broken line in FIG. 8 passes through a conveying roller 23*b,* which is disposed on the downstream side in the thin slab conveying direction with respect to the induction heating coil 22, and a ground line G, reaches a conveying roller 23*a* disposed on the upstream side in the thin slab conveying direction with respect to the induction heating coil 22, and returns to the thin slab 21, the axial current $i_2$ being a circulating current that circulates along the loop. As a result, by this circulating current, a spark (arc) is produced between the thin slab 21 and the conveying roller 23*a* and between the thin slab 21 and the conveying roller 23*b,* so that the back surface of the thin slab 21 arranged corresponding to the conveying rollers 23*a* and 23*b,* especially the side edge portion of the back surface thereof, is damaged greatly by overheat caused by the spark, and also the surfaces of the conveying rollers 23*a* and 23*b* are electrolytically corroded. The lead angle of the coil winding is not zero depending on the winding construction even if the mechanical lead angle θ of the coil winding with respect to the thin slab width direction shown in FIG. 10 is zero. This is because for the single-layer, multi-wound solenoid-type coil, an axial current component is always present in accordance with the size in the depth direction.

Accordingly, as the most general countermeasures against the occurrence of the axial current $i_2$ as described before and against the damage and electrolytic corrosion of the thin slab 21, a method in which the plurality of rollers 23 are insulated from the ground line (earth potential) has been used conventionally. However, this method has a problem in that each of the conveying rollers 23 must be insulated, so that the equipment becomes complicated and expensive. As an alternative, the conveying rollers 23 may be made of a ceramic material. In this case, the ceramic roller is high in cost, and is easily scraped or cracked, so that a problem of durability is actually presented. Further, as other countermeasures, various methods have been tried, such as a method in which the conveying roller 23 formed by ceramic coating the surface of a stainless steel roller is used, or a method in which a base for supporting the shaft of the conveying roller 23 is insulated from the ground line. However, all of these methods are dissatisfactory in terms of ease of manufacture, price, and durability of equipment.

Also, as the conventional alternative countermeasures against the occurrence of the axial current $i_2$, a method is sometimes used, in which as shown in FIG. 9, an iron core 30 formed by laminating silicon steel plates is disposed around induction heating coils 22 so that the whole or part of magnetic path generated on the outside of the coils 22 is covered by the iron core 30. In this case, the direction of the plane of the silicon steel plate is made in parallel with the magnetic flux in the direction of the coil axis $S_1$, by which the magnetic flux at right angles to the direction of the coil axis $S_1$ is shut off by the iron core 30. However, this method is dissatisfactory because the construction for cooling and supporting the iron core 30 is very complex, so that there is difficulty in manufacturing and the price is very high, especially in the equipment of high electric power.

The present invention has been made in view of the above-described actual situation of the prior art, and accordingly an object thereof is to provide an induction heating coil, in which the occurrence of a circulating current (a circulating current causing a spark produced on a contact face between the heated body and the conveying roller) harmful to induction heating, which flows circularly in a heated body such as a thin slab and conveying rollers can be prevented by contriving the way of winding of the induction heating coil, and therefore the damage to the heated body caused by the circulating current flowing in the heated body along the coil axis direction and the electrolytic corrosion of the conveying roller can be prevented, and an induction heating apparatus using this coil.

DISCLOSURE OF THE INVENTION

To achieve the above object, the present invention provides an induction heating coil for induction heating a heated body by surrounding the heated body, characterized in that the induction heating coil is formed by a first coil portion wound in a spiral form while transferring in one direction along a coil axis and a second coil portion which is connected to a terminal of the first coil portion and wound back while transferring in the other direction along the coil axis, the first and second coil portions being combined so as to overlap in the non-contact state.

Also, in the present invention, the number of turns of the first and second coil portions is set so as to be equal.

Also, the present invention provides an induction heating apparatus comprising:

(A) a plurality of conveying rollers arranged at intervals along a predetermined conveying path;

(B) an induction heating coil which is formed by a first coil portion wound in a spiral form while transferring in one direction along a coil axis and a second coil portion which is connected to a terminal of the first coil portion and wound back while transferring in the other direction along the coil axis, the coil portions being combined so as to overlap in the non-contact state, and is disposed between the adjacent conveying rollers; and (C) a high frequency power source for supplying high frequency electric power to the induction heating coil, in which a heated body, which is placed on the plurality of conveying rollers and conveyed in a predetermined direction, is induction heated by being passed through a hollow portion of the induction heating coil.

Also, in the present invention, the heated body is a thin slab which is continuously cast and conveyed, and coil winding portions of the induction heating coil arranged corresponding to the upper and lower surfaces of the thin slab agree with the width direction of the thin slab.

BEST MODE FOR CARRYING OUT THE INVENTION

Embodiments of the present invention will now be described in detail with reference to FIGS. 1 to 7.

Figure 1:
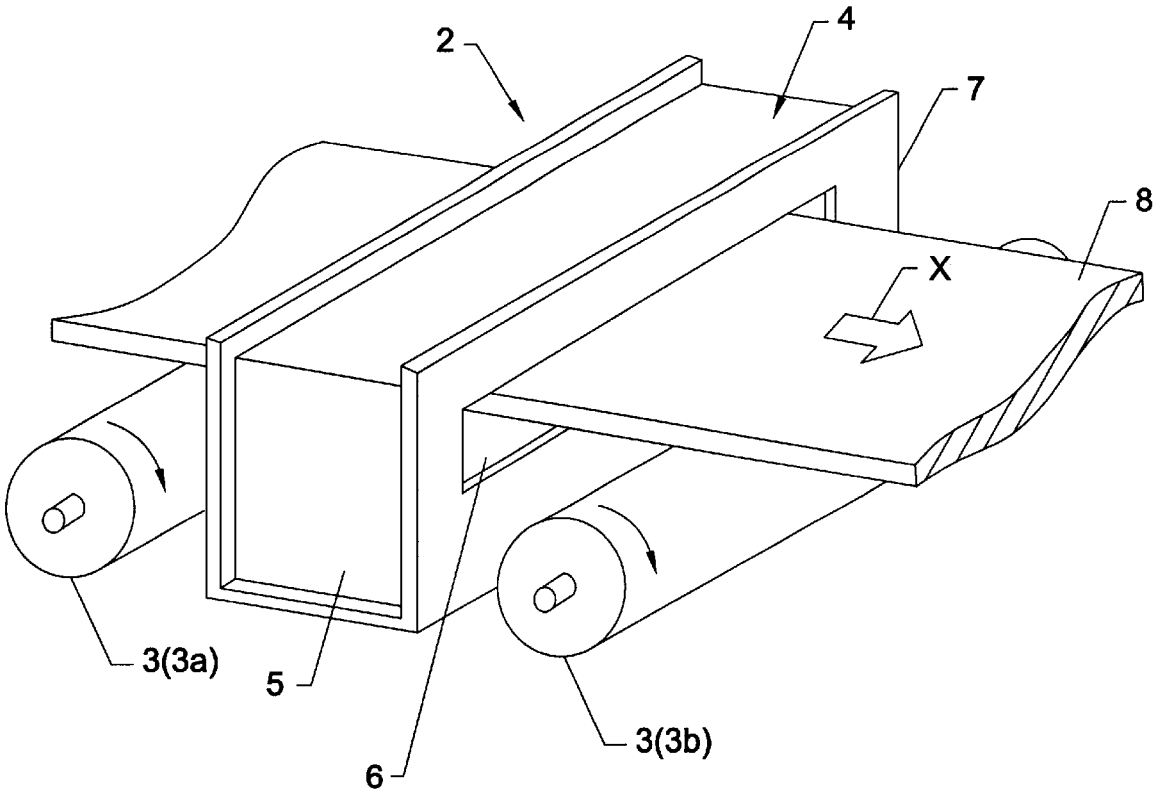
FIG. 1 is a perspective view schematically showing a principal portion of an induction heating apparatus in accordance with the present invention.
Figure 2A:
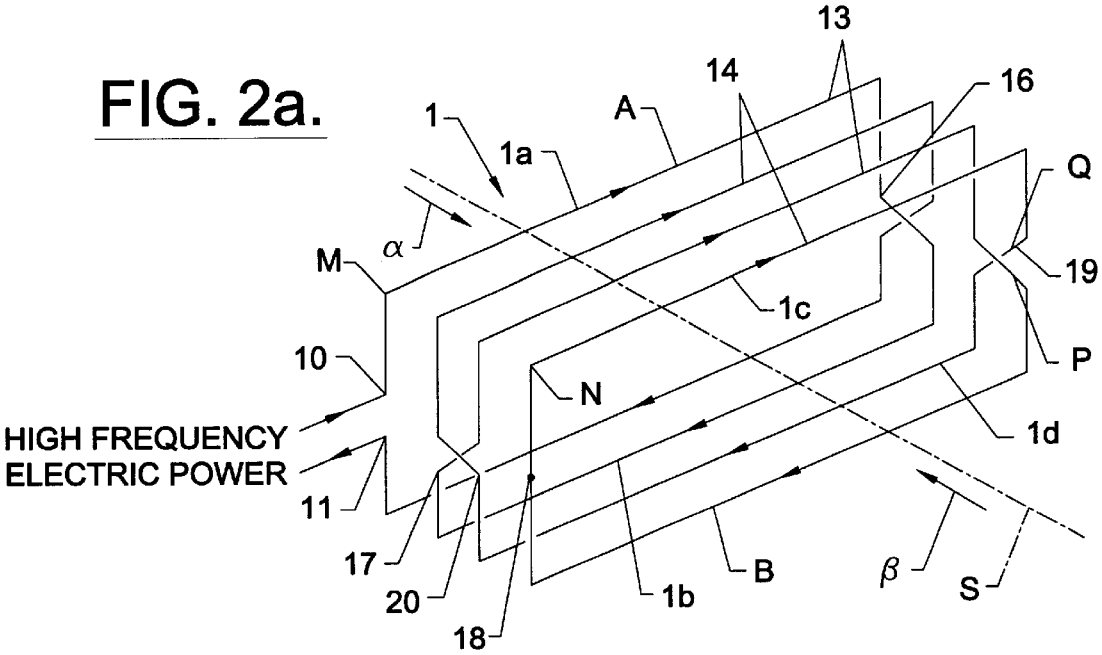
FIG. 2 is a view showing a winding construction of an induction heating coil in accordance with a first embodiment of the present invention, which is used for the induction heating apparatus shown in FIG. 1, FIG. 2(*a*) being a perspective view showing the whole of the induction heating coil, and FIG. 2(*b*) being an enlarged perspective view showing a side portion of the induction heating coil.
Figure 2B:
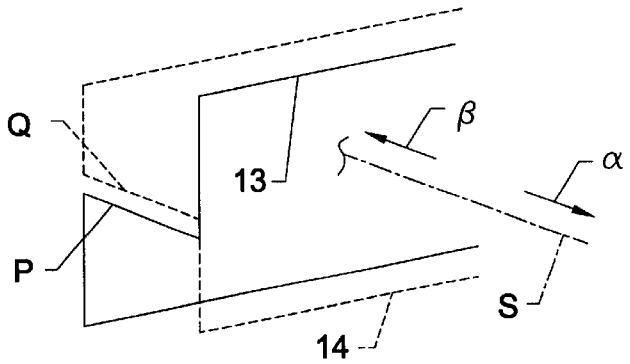

FIG. 1 shows an induction heating apparatus using a solenoid-type induction heating coil 1 (see FIG. 2(*a*)) in accordance with a first embodiment of the present invention. This apparatus 2 is an apparatus for induction heating a thin slab continuously cast on a hot coil production line at an electric furnace minimill to a required temperature. As shown in FIG. 1, the aforementioned induction heating apparatus 2 is made up of a plurality of conveying rollers 3 disposed in parallel at intervals in a predetermined direction, a furnace body 4 disposed between the adjacent conveying rollers 3, and a high frequency power source (not shown) for supplying high frequency electric power to the induction heating coil 1 incorporated in the furnace body 4. Although only one set of conveying/heating mechanism consisting of two adjacent conveying rollers 3*a* and 3*b* and one furnace body 4 disposed between these conveying rollers 3*a* and 3*b* is shown in FIG. 1, the conveying/heating mechanism of the same construction may be arranged at a plurality of places at equal intervals (an interval of about 700 mm) along a thin slab conveying path (hot coil production line). Each of the conveying rollers 3 is caused to rotate individually by an electric motor or the like, not shown in the figure.

Figure 3:
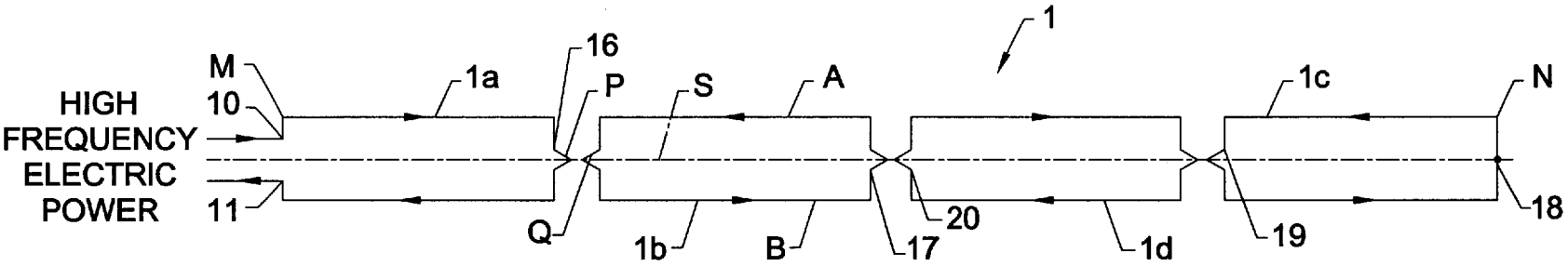
FIG. 3 is a development of the induction heating coil shown in FIG. 2(*a*)
Figure 4:
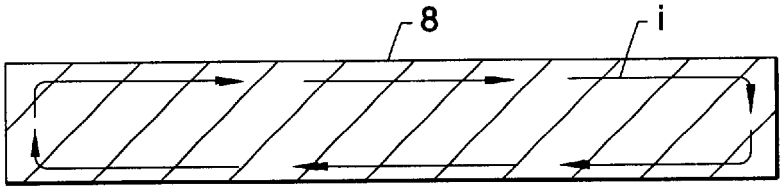
FIG. 4 is an explanatory view showing an induced current flowing on the surface of a thin slab, which is a heated body.

The furnace body 4 contains the solenoid-type induction heating coil 1 having a winding construction as shown in FIG. 2(*a*) and FIG. 3, which is covered by thermally and electrically insulating cement 5. The central portion of the thermally and electrically insulating cement 5 is formed with an opening 6 for inserting the thin slab, and the front and back faces excluding the opening 6 of the insulating cement 5 as well as the bottom face thereof is covered by a shield plate 7. Although not shown in the figure, the top face and the right and left side faces of the thermally and electrically insulating cement 5 should preferably be covered by the shield plate 7, if possible. Thus, a thin slab 8, which has been continuously cast at a continuous casting section and transported to an induction heating section, is placed and supported on the plurality of conveying rollers 3 at the induction heating section, and conveyed on the plurality of conveying rollers 3 at a predetermined conveying speed in the direction indicated by the arrow mark X in FIG. 1. The thin slab 8 is inserted into the opening 6 of the furnace body 4 and passes through the central portion of the opening 6. The induction heating coil 1 in the thermally and electrically insulating cement 5 is supplied with high frequency electric power of a predetermined frequency from a high frequency power source not shown in the figure.

The following is a detailed description of the winding construction of the induction heating coil 1 used in the first embodiment of the present invention. As shown in FIG. 2(*a*), the induction heating coil 1 is of a so-called four-turn construction in which a total of four turns of coil windings are wound along rectangular paths, and an inlet terminal 10 and an outlet terminal 11 of the high frequency power source are provided at the left winding portion (the start and terminal ends of the coil winding in the direction of the coil axis S). Here, for easy understanding of the coil construction of the induction heating coil 1, a development of coil winding is shown in FIG. 3. The development shown in FIG. 3 corresponds to a coil shape in the case where coil locations indicated by reference characters M and N in FIG. 2(*a*) are spread in the direction such that these coil locations are distant from each other along the direction of the coil axis S.

As clearly shown in FIG. 2(*a*), the induction heating coil 1 used for the induction heating apparatus of this embodiment is combinedly consists of a first coil portion 13 which is wound in a spiral form while transferring in one direction (the direction of the arrow mark α) along the coil axis S, and a second coil portions 14 which is wound while transferring in the other direction (the direction of the arrow mark β) along the coil axis S, which coil portions being overlapped in a non-contact state. Specifically, the winding construction of the aforementioned induction heating coil 1 will be described in detail. First, the coil is wound along a rectangular path (U-shaped path) on the upper side of the coil axis S from the inlet terminal 10 of the high frequency electric power, being bent so as to transfer in the direction of the arrow mark α along the coil axis S and in parallel with the coil axis S at an end portion 16 of a U-shaped upper winding portion 1*a*, and then is wound along a lower rectangular path of the coil axis S. Thereafter, the coil is bent so as to transfer in the direction of the arrow mark α along the coil axis S and in parallel with the coil axis S at an end portion 17 of a U-shaped lower winding portion 1*b*, and then is wound along the next upper rectangular path of the coil axis S. Thus, such a winding construction is repeated, by which the two-turn first coil portion 13 is formed.

Further, the second coil portion 14 is provided from a turn point 18, which is the terminal of the first coil portion 13 transferring in the direction of the arrow mark α. More specifically, the coil rises upward from the turn point 18, and is wound along the upper rectangular path of the coil axis S. Thereafter, the coil is bent so as to transfer in the direction of the arrow mark β along the coil axis S and in parallel with the coil axis S at an end portion 19 of a U-shaped upper winding portion 1*c*, and then is wound along the lower rectangular path of the coil axis S. After that, the coil is bent so as to transfer in the direction of the arrow mark β (the direction opposite to the α direction) along the coil axis S and in parallel with the coil axis S, and then wound along the next upper rectangular path of the coil axis S. Thus, such a winding construction is repeated, the coil being wound and returned to the outlet terminal 11 of high frequency electric power opposite to the inlet terminal 10, by which the two-turn second coil portion 14 is formed.

Although coil side portions P and Q between the upper winding portions 1*a* and 1*c* and the lower winding portions 1*b* and 1*d* (forward and reverse windings) are shown so as to intersect each other in FIG. 2(*a*), actually, as shown in FIG. 2(*b*), these coil side portions are in parallel with each other and also in parallel with the coil axis S, so that a minimum gap (for example, a gap of about 10 mm) for providing a dielectric withstanding voltage so as to cancel inductance. On the other hand, the rectangular coil portion of each turn excluding the coil side portions P and Q is arranged in parallel in the non-contact state. The first and second coil portions 13 and 14 are combined in an overlapped state. Also, in the case of the induction heating coil 1 of this example, the inlet terminal 10 and the outlet terminal 11 of the high frequency electric current (power supply terminals of the high frequency electric power) are disposed at one end location in the coil axis S direction. Therefore, the first coil portion 13 is wound to the left (forward direction) viewed in the depth direction from the side of the inlet terminal 10 of the high frequency electric current, and the second coil portion 14 is wound to the right (reverse direction) viewed in the depth direction from the side of the outlet terminal 11 of the high frequency electric current. In other words, the coil is wound to the left from the inlet terminal 10 to the turn point 18, and is wound to the right from the turn point 18 to the terminal 11. That is to say, even if the winding direction is the same as viewed from one side, the winding direction is reverse between the case where the coil is wound from one side to the other side and the case where the coil is wound from the other side to one side.

Although the upper winding portions 1*a* and 1*c* and the lower winding portions 1*b* and 1*d* are set so as to have a lead angle of 0°, the lead angles at the coil side portions P and Q are set at 90° and −90°, respectively. Here, the first coil portion 13 and the second coil portion 14, which constitute one winding as a whole, are connected to each other at the turn point 18, and the winding is symmetrical with respect to the horizontal plane including the coil axis S (see FIG. 3).

Thus, the induction heating coil 1 having such a winding construction is incorporated in the furnace body 4 as described above, and is arranged so as to be in parallel with the width direction of the thin slab 8, which is conveyed by the plurality of conveying rollers 3. Therefore, the upper winding portion A and the lower winding portion B (see FIGS. 2 and 3) of the induction heating coil 1 are arranged in parallel with the width direction of the thin slab 8, and the lead angle is set at 0°.

The following is a description of the operation in the case where the thin slab 8 is induction heated by the induction heating apparatus 2 of this embodiment. First, the thin slab 8 having been continuously cast is placed on the plurality of the conveying rollers 3 and conveyed to the furnace body 4 and inserted in the opening 6 of the furnace body 4. On the other hand, the induction heating coil 1 is supplied with high frequency electric power from a not illustrated high frequency power source. Accordingly, as indicated by the arrow marks in FIGS. 2 and 3, a high frequency current flowing in the induction heating coil 1 circulates from the inlet terminal 10 to the upper winding portion 1*a,* to the lower winding portion 1*b* connecting with the upper winding portion 1*a,* and to the upper and lower winding portions connecting thereto in succession, reaching the turn point 18. Then, the high frequency current circulates from this turn point 18 to the upper winding portion 1*c,* to the lower winding portion 1*d* connecting with the upper winding portion 1*c,* and to the upper and lower winding portions connecting thereto in succession, returning to the outlet terminal 11. The induction heating coil 1 is excited by the high frequency electric power, and accordingly an alternating magnetic flux is produced. This alternating magnetic flux generates an eddy current on the surface of the thin slab 8. At this time, in the thin slab 8, an eddy current (induced current i), which loops the top surface and the back surface of the thin slab 3 as indicated by the arrow marks in FIG. 4, flows, whereby the thin slab 8 is induction heated. The leakage flux at this time is shut down by the shield plate 7, so that the heat generation of the surrounding metal parts caused by the leakage flux to the outside can be prevented.

According to the induction heating apparatus 2 thus constructed, since the induction heating coil 1 of the winding construction as described above is used, if the lead angle of the coil winding is θ (+90°) at the inclined portion P of the first coil portion 13, which is the left winding, the lead angle is −θ (−90°) at the inclined portion Q of the second coil portion 14, which is the right winding, so that the axial current components can be canceled. In this case, the inductance is also canceled advantageously. This enables the axial current, which circulates the outside via the conveying rollers etc., to be prevented from being produced in the components of the induced current flowing in the thin slab 8. Actually, the magnitude of the axial current can be decreased to a very small value of a negligible degree.

Figure 5:
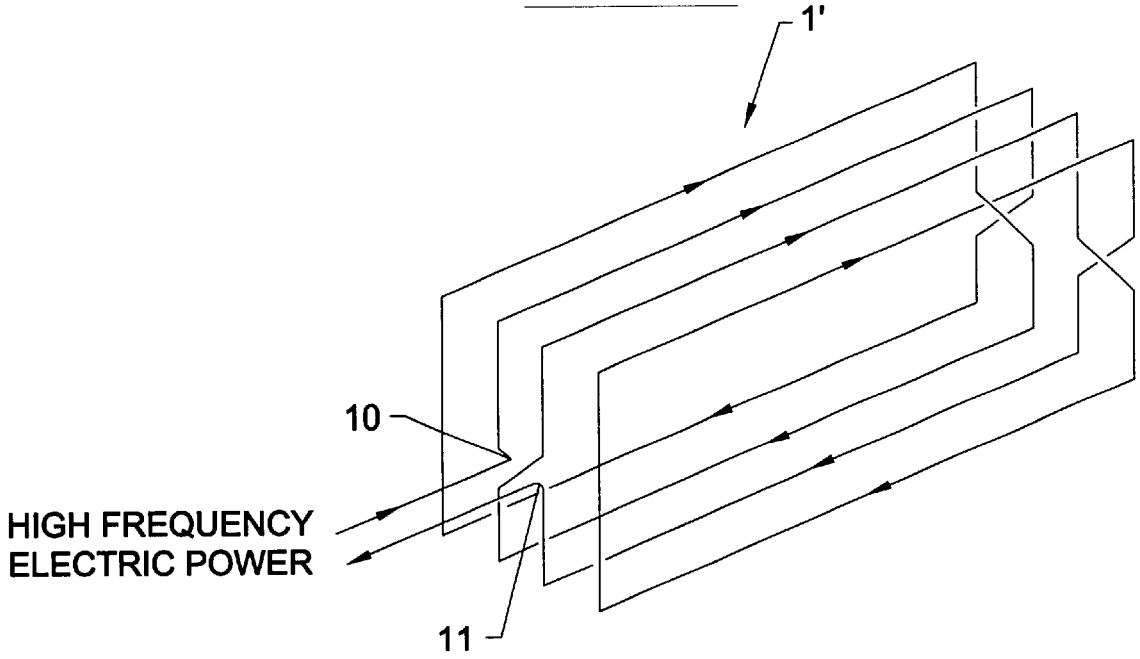
FIG. 5 is a perspective view showing a winding construction of an induction heating coil in accordance with a second embodiment of the present invention.
Figure 6:
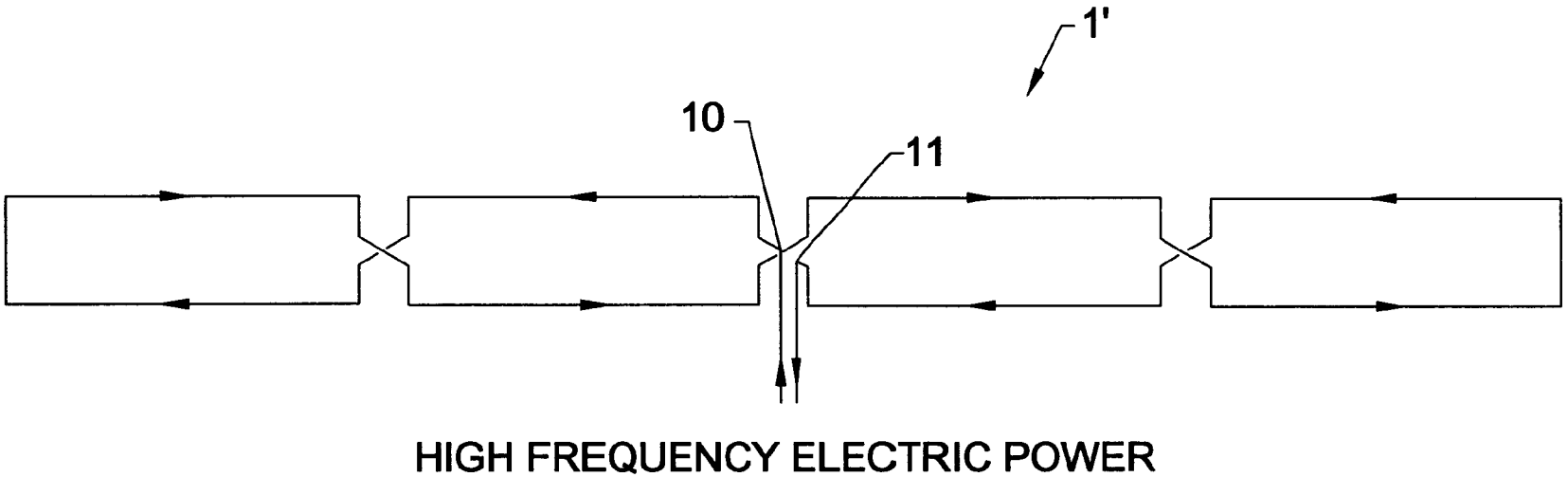
FIG. 6 is a development of the induction heating coil shown in FIG. 5.

Also, FIGS. 5 and 6 show an induction heating coil 1' in accordance with a second embodiment of the present invention. For this induction heating coil 1', the inlet terminal 10 and the outlet terminal 11 of the high frequency electric current are provided at an arbitrary intermediate location of the winding of a plurality of turns. The induction heating coil 1' has the same construction as that of the induction heating coil 1 of the first embodiment except that the positions of the inlet terminal 10 and the outlet terminal 11 differ from those of the induction heating coil 1 of the first embodiment. The induction heating coil 1' having such a construction also achieves the same operation and effect as the aforementioned ones of the induction heating coil 1.

Figure 7:
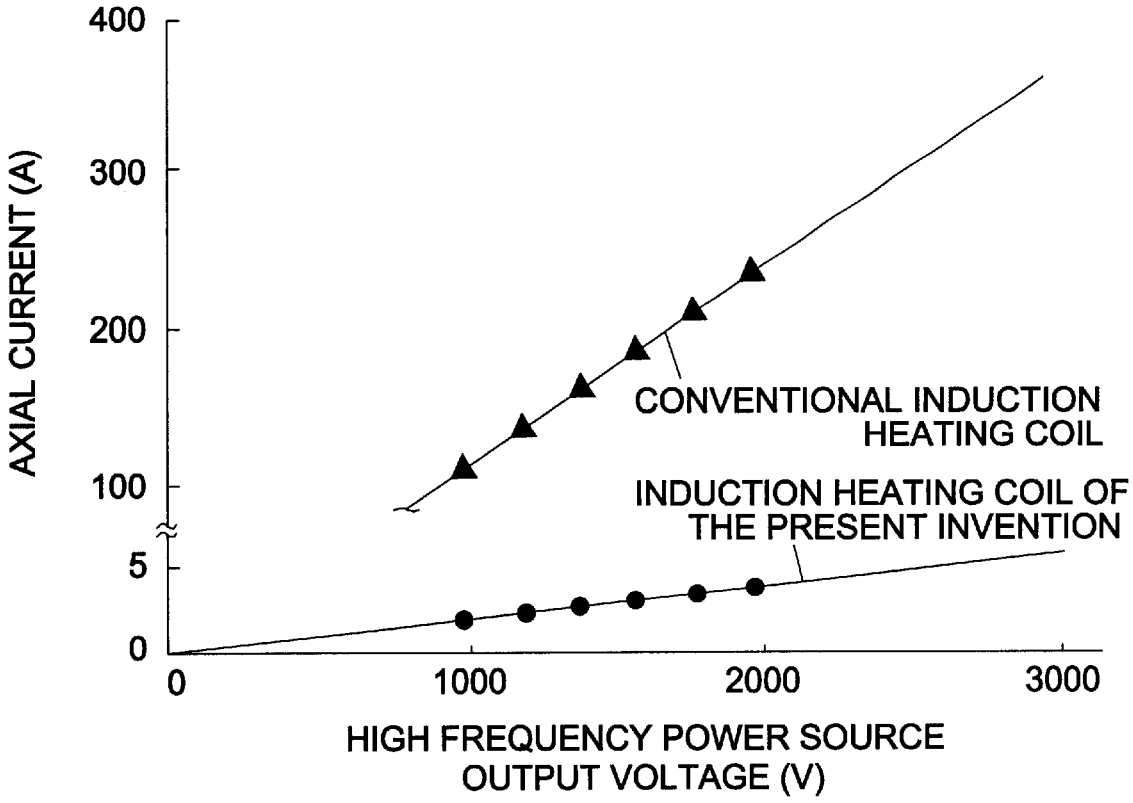
FIG. 7 is a graph showing the result of measurement of an axial current produced when the thin slab is induction heated by using the induction heating coil in accordance with the present invention and an axial current produced when the thin slab is induction heated by using a conventional induction heating coil.
Figure 8:
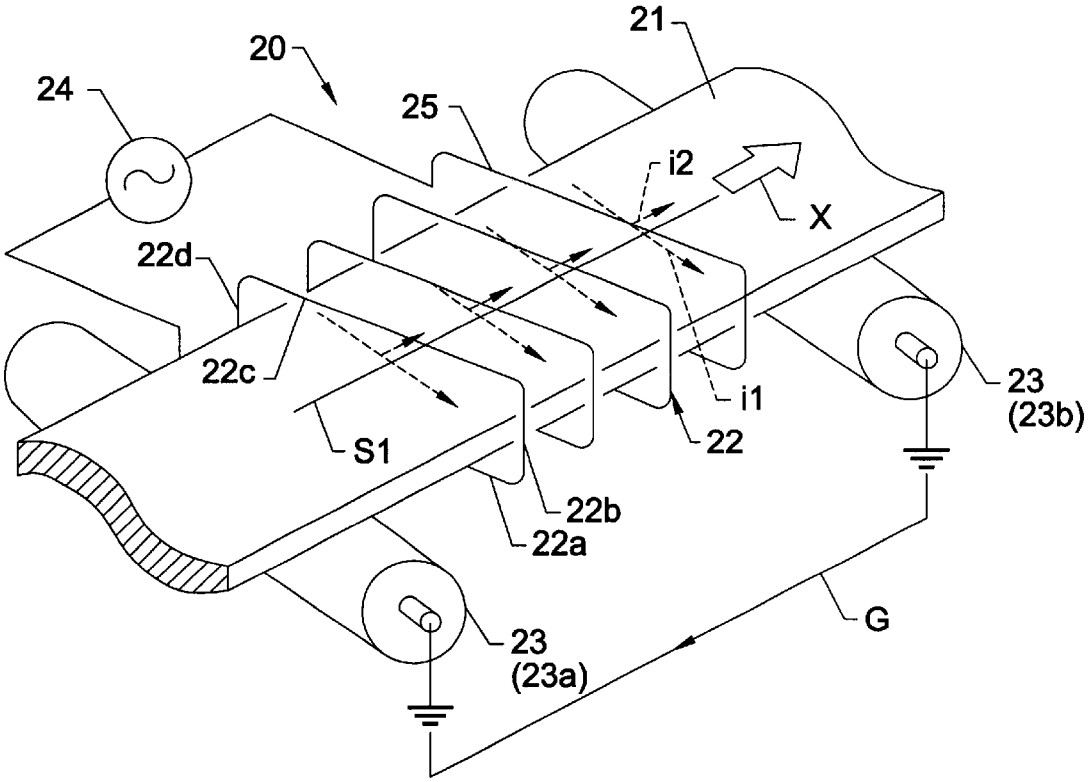
FIG. 8. (PRIOR ART)
FIG. 8 is a perspective view schematically showing a construction of a principal portion of a conventional induction heating apparatus.
Figure 9:
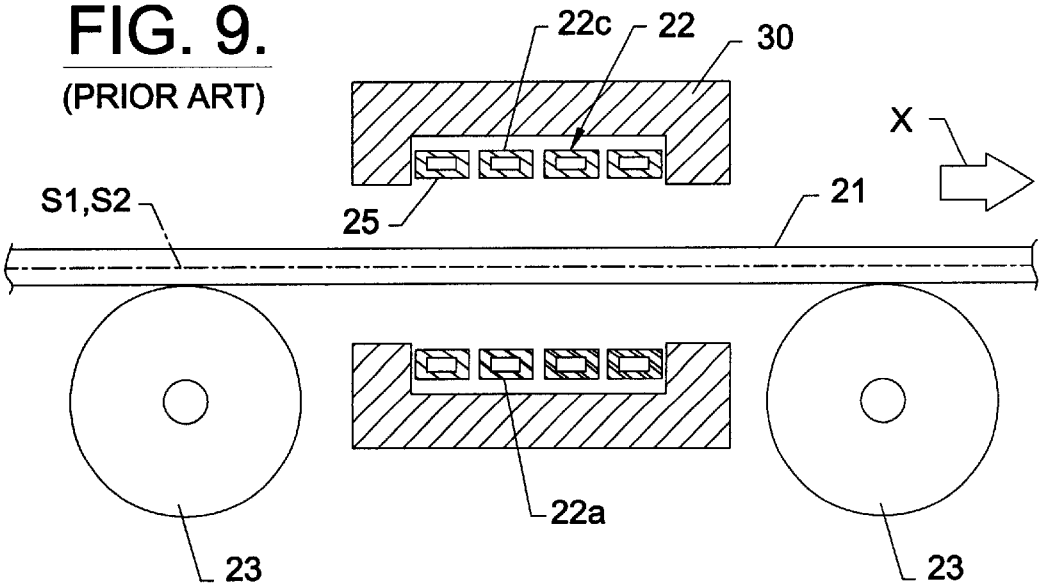
FIG. 9. (PRIOR ART)
FIG. 9 is a sectional view of a principal portion of the induction heating apparatus shown in FIG. 8.
Figure 10:
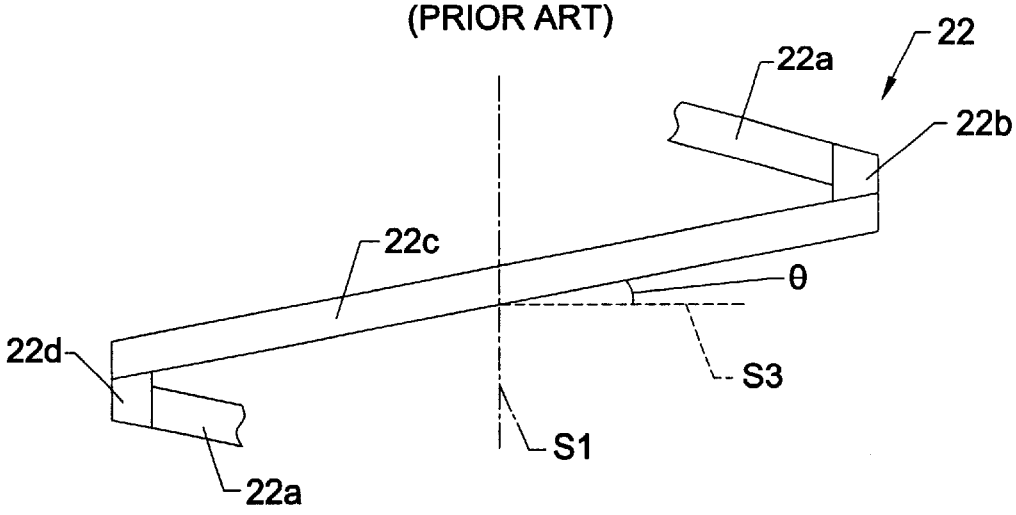
FIG. 10. (PRIOR ART)
FIG. 10 is an explanatory view showing a lead angle (lead angle of coil winding) of an induction heating coil used for the induction heating apparatus shown in FIG. 8.
Figure 11:
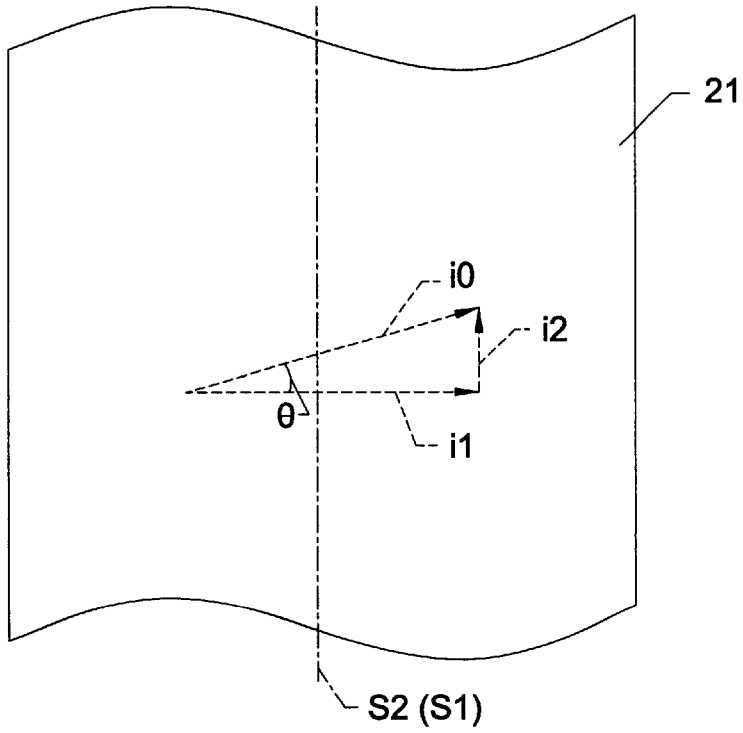
FIG. 11. (PRIOR ART)
FIG. 11 is an explanatory view showing components of an induced current produced in the thin slab when the thin slab is induction heated by the induction heating apparatus shown in FIG. 8.

Experiments were made to verify the above-described effect of decreased axial current caused by the induction heating coils 1 and 1', and the results as shown in FIG. 7 were obtained. The measurement conditions for the experiments were as follows:

Measurement conditions (1) Frequency of high frequency power source: 5.5 KHz (2) Output voltage of high frequency power source: 1000 to 2000 V (3) Load: No load (4) Object being measured: A copper plate of 1800 mm (length)×30 mm (width)×6 mm (thickness) was made into a loop shape, and a loop current passing through the coil axis was measured by a sensor.

From these experimental results, it was verified that according to the induction heating coils 1 and 1' in accordance with the present invention, the axial current (i.e., circulating current) produced in the thin slab 8 can be decreased to about 1/50 as compared with the case of the conventional induction heating coil.

The above is a description of the embodiments of the present invention. The present invention is not limited to these embodiments, and various modifications and changes can be made on the basis of the technical concept of the present invention. For example, the number of turns of the induction heating coil 1, 1' can be set arbitrarily regardless of an even number and an odd number, and the number of turns is not limited. Also, the inlet terminal 10 and the outlet terminal 11 of the induction heating coil 1, 1' can be provided at any location of the winding, and also can be provided over arbitrary two winding portions. Although the case where the heated body is the thin slab 8 has been described in the above embodiments, the induction heating coil in accordance with the present invention and the induction heating apparatus using this coil can be applied to induction heating of all kinds of metallic material plates of not only steel but also aluminum, copper, and the like and all shapes of heated bodies such as plates, rods, and pipes.

Further, although the upper winding portion A and the lower winding portion B of the induction heating coil 1 are arranged in parallel with the width direction of the thin slab 8 so that the lead angle is 0° in the above-described first and second embodiments, even if the upper winding portion A and the lower winding portion B are arranged so as to make an angle with respect to the width direction of the thin slab 8, or even if the winding construction is such that the upper winding portion A and the lower winding portion B intersect, the aforementioned operation and effect of the present invention can be achieved.

As described above, the present invention provides an induction heating coil formed by a first coil portion wound in a spiral form while transferring in one direction along a coil axis and a coil portion which is connected to a terminal of the first coil portion and wound back while transferring in the other direction along the coil axis, the coil portions being combined so as to overlap in the non-contact state, and an induction heating apparatus using this coil. Therefore, according to the present invention, when a heated body is subjected to high frequency induction heating, an axial current produced in the heated body by electromagnetic induction from the induction heating coil can be canceled, so that the generation of a circulating current can be prevented. Further, according to the induction heating coil of the present invention, the inlet terminal and the outlet terminal of the induction heating coil to which high frequency electric power is connected can be provided at any winding portion.

Thereupon, practical effects as described below can be achieved.

(1) A spark due to the circulating current does not occur between the heated body and the conveying roller. As a result, the damage to the heated body caused by the spark and the electrolytic corrosion of the conveying roller can be prevented. Therefore, high-quality products can be obtained from the heated body, and also the durability of the conveying roller can be increased.

(2) The induced current flowing in the heated body does not include the axial current circulating the outside, that is, the harmful circulating current that is ineffective in heating the heated body. Therefore, the heating efficiency of the heated body can be enhanced.

(3) There is no need for using a special conveying roller, an iron core in which silicon steel plates are laminated, or the like. Therefore, a lower-cost induction heating apparatus (facility) with high reliability and durability can be provided at a lower cost by an easier method.

(4) For the induction heating coil in accordance with the present invention, the inlet terminal and the outlet terminal, which are connected to a high frequency power source, can be provided at any winding of a plurality of windings for the reason of construction. Therefore, the degree of freedom in system design of the facility can be increased.

(5) Depending on the terminal construction of the inlet terminal and the outlet terminal connected to the high frequency power source, the distance for laying a lead line increases and therefore ineffective inductance increases. However, for the induction heating coil of the present invention, these terminals can be provided at the same turning portion, so that there is no need for laying the lead line. Therefore, the ineffective inductance becomes at a minimum, thereby reducing a leakage flux, and in turn the heating efficiency of the heated body can be enhanced.

Industrial Applicability

As described above, the induction heating coil in accordance with the present invention and the induction heating apparatus using this induction heating coil are useful as an induction heating coil and an apparatus for heating hot rolled steel etc. being moved by surrounding the hot rolled steel etc. which are placed on a plurality of conveying rollers and conveyed. Therefore, this induction heating coil and the apparatus are suitable for the high frequency induction heating of a thin slab in a moving state on a continuous production line.

What is claimed is:

1. An induction heating apparatus for heating a body, comprising:

an induction heating coil having a single layer winding structure at least partially surrounding the body, said induction heating coil defining a coil axis and having first and second portions, said first portion of said induction heating coil being wound in a spiral form while transferring in a first direction along the coil axis, said second portion of said induction heating coil being wound in a spiral form while transferring along the coil axis in a direction opposite to the first direction, and wherein said first and second portions of said induction heating coil are adapted to substantially cancel inductance in the body along the coil axis; and a high frequency power source in electrical communication with said induction heating coil for supplying high frequency electric power to said coil to thereby heat the body.

2. The apparatus according to claim 1 wherein said first and second portions of said induction heating coil have an equal number of turns.

3. The apparatus according to claim 1 further comprising a plurality of conveying rollers arranged at intervals along a predetermined conveying path for conveying the body through the interior of said induction heating coil.

4. The apparatus according to claim 1 wherein the body is a thin slab which is continuously cast and conveyed, and said first and second portions of said induction heating coil are arranged corresponding to the upper and lower surfaces of the thin slab and agree with the width direction of the thin slab.

5. The apparatus according to claim 1 wherein at least one winding of said second portion of said induction heating coil being at least partially disposed between at least one pair of adjacent windings of said first portion of said induction heating coil.

6. The apparatus according to claim 1 wherein said first and second portions of said induction heating coil have the same winding direction.

7. An induction heating apparatus for heating a body, comprising:

an induction heating coil having a single layer winding structure at least partially surrounding the body, said induction heating coil defining a coil axis and having first and second portions, said first portion of said induction heating coil being wound in a spiral form while transferring in a first direction along the coil axis, said second portion of said induction heating coil being wound in a spiral form while transferring along the coil axis in a direction opposite to the first direction, and wherein said first and second portions of said induction heating coil define at least one pair of opposed coil side portions, said at least one pair of opposed coil side portions adapted to substantially cancel inductance in the body along the coil axis; and a high frequency power source in electrical communication with said induction heating coil for supplying high frequency electric power to said coil to thereby heat the body.

8. The apparatus according to claim 7 wherein said first and second portions of said induction heating coil have an equal number of turns.

9. The apparatus according to claim 7 further comprising a plurality of conveying rollers arranged at intervals along a predetermined conveying path for conveying the body through the interior of said induction heating coil.

10. The apparatus according to claim 7 wherein the body is a thin slab which is continuously cast and conveyed, and said first and second portions of said induction heating coil are arranged corresponding to the upper and lower surfaces of the thin slab and agree with the width direction of the thin slab.

11. The apparatus according to claim 7 wherein said at least one pair of opposed coil side portions intersect each other at lead angles different by 180 degrees.

12. The apparatus according to claim 7 wherein said first and second portions of said induction heating coil have the same winding direction.

13. A method of induction heating a body, comprising:

moving the body through the interior of an induction heating coil along the coil axis, the induction heating coil having a single layer winding structure and having first and second portions being adapted to substantially cancel inductance in the body along the coil axis; and inducing a current in the body, the induced current being substantially parallel to the coil axis to thereby heat the body.

14. A method according to claim 13 wherein at least one winding of the second portion of the induction heating coil being at least partially disposed between at least one pair of adjacent windings of the first portion of the induction heating coil.

* * * * *

UNITED STATES PATENT AND TRADEMARK OFFICE

CERTIFICATE OF CORRECTION

PATENT NO. : 6,300,608 B1
DATED : October 9, 2001
INVENTOR(S) : Inoh et al.

It is certified that error appears in the above-identified patent and that said Letters Patent is hereby corrected as shown below:

Title page,
Item [56], References Cited., FOREIGN PATENT DOCUMENTS, "58-15889" should read -- 58-158889 --.

Signed and Sealed this

Ninth Day of April, 2002

*Attest:*

*Attesting Officer*

JAMES E. ROGAN
*Director of the United States Patent and Trademark Office*